US006701097B1

(12) United States Patent
Carter et al.

(10) Patent No.: US 6,701,097 B1
(45) Date of Patent: Mar. 2, 2004

(54) MOVEMENT TRACKING BY TIME AND SCALING FOR START AND STOP

(75) Inventors: Philip Scot Carter, Lexington, KY (US); Benjamin Keith Newman, Lexington, KY (US); William Keith Richardson, Salvisa, KY (US); Kevin Dean Schoedinger, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/320,967

(22) Filed: Dec. 17, 2002

(51) Int. Cl.[7] ..... G03G 15/08

(52) U.S. Cl. ..... 399/27

(58) Field of Search ..... 399/58, 61, 62, 399/30, 256, 27

(56) References Cited

U.S. PATENT DOCUMENTS 5,310,423 A * 5/1994 Aimoto et al. ..... 399/62
5,634,169 A 5/1997 Barry et al.
6,100,601 A * 8/2000 Baker et al. ..... 399/27

* cited by examiner

*Primary Examiner*—Susan S.Y. Lee
(74) *Attorney, Agent, or Firm*—John A. Brady

(57) ABSTRACT

Toner hopper (1) of a printer (70) has a stirring paddle (3) with an encoder wheel (30, 50) mounted on paddle shaft (5). The drive connection to paddle (3) is through a torsion spring (60). Data processing apparatus determines paddle acceleration or deceleration (90, 94, 98, 102) and executes a table look-up to determine scaled amounts of subsequent movement (92, 96, 100, 104). Steady state movement is a unitary (unscaled) amount (106). These amounts are totaled (93) and used to define yield at the torsion spring, which corresponds to amount of toner in the hopper. This eliminates hardware in previous embodiments at the drive motor to signal actual rotation of the drive motor.

16 Claims, 9 Drawing Sheets

MOVEMENT TRACKING BY TIME AND SCALING FOR START AND STOP

TECHNICAL FIELD

This invention relates to measuring the amount of particulate toner in a hopper, such as the measuring of remaining toner in an electrostatic imaging device. More specifically, this invention relates to measuring toner by determining the torque required to drive a toner paddle where the torque (or a derivative measurement) is proportional to the amount of toner through which the paddle moves.

BACKGROUND OF THE INVENTION

A toner cartridge from which the current level of toner is measured at the printer using the data processing apparatus of the printer is disclosed in U.S. Pat. No. 5,634,169, assigned to the assignee to which this application is assigned. This discloses a torsion spring mounted drive to the toner-stirring paddle, which rotates in the hopper containing toner. When the toner reaches a certain level of depletion, the torsion spring yields less and less as the toner is depleted. The shaft to the toner paddle carries an encoder wheel, which may have multiple slots or other indicia for observation, but for the purpose of measuring toner, need only have spaced beginning and end slots. The time between observing the beginning slot and the end slot is related in a known amount to toner quantity, and pertinent factors are stored and the necessary data processing is carried out at the printer. Because of the varying postures of toner which occur in a hopper with stirring paddle, a running average is employed as the current toner-quantity measurement, a typical average being that of the last five paddle revolutions.

In practice known printers employing the foregoing torsion-measuring system employed an electric drive motor which produced information pulses at predetermined locations of the drive motor. This accurately defined the amount of movement to the torsion spring regardless of acceleration or deceleration. This invention avoids the expense of the hardware to provide those information pulses, and provides accurate results which provide for acceleration, deceleration, and steady state even though the operation of the printer may be interrupted prior to reaching steady state, and then resumed for a later printing operation.

DISCLOSURE OF THE INVENTION

In accordance with this invention the movement of a paddle driven through toner from a yieldable drive, which may be a torsion spring in an embodiment, is determined by scaling time period values during acceleration and deceleration and by treating steady state periods of movement as having a fixed value, which conceptually is a value of one for a given time period. During the same time period, the amount of movement in acceleration or deceleration will be less than the amount of movement at steady state.

As in the prior system, a tracking device with indicia, which may be an encoder wheel in an embodiment, has a recognizable home window (recognized as being wide in the embodiment) and a recognizable toner-sensing window spaced from the home window (recognized as being narrow in the embodiment). The amount of delay relative to movement of the drive to the torsion spring and of the movement between the home window and the toner sensing window represents yield at the torsion spring and is a measurement of the amount of remaining toner in the hopper in which the paddle turns.

To determine the actual movement of the drive to the torsion spring a conversion formula is stored (preferably by a look-up table) defining empirical data relating the amount of drive movement to the torsion spring to time periods. Similarly, a conversion formula is stored defining amount of movement during acceleration or deceleration depending on time of acceleration or deceleration. For steady state operation a single factor is stored.

Since the machine control software initiates all acceleration and decelerations, each initiation is used to start timings and calculations. Both the movements during acceleration and during deceleration are timed, scaled by the conversion formula, and summed, thus defining the location of the windows and the amount of yield. When steady state is reached, of course, then the amount of one unit for each time period is added. An acceleration and deceleration sequence performed without reaching steady state is scaled using the factors for the acceleration and deceleration with no unit factor.

Drive motors typically provide a "lock' signal showing they are about to enter steady state status. Although that signal might be used to define the beginning of steady state operation, the conversion formula inherently provides the same information and can be used to define the beginning of steady state operation. In either case this invention eliminates the need for any apparatus at the printer to provide positional feedback signals.

BRIEF DESCRIPTION OF THE DRAWINGS

The details of this invention will be described in connection with the accompanying drawings, in which.

DESCRIPTION OF THE PREFERRED EMBODIMENTS

Toner cartridges are toner containers that can be separated and replaced in the printer. Toner cartridges typically have some printing elements such as a developer roller with doctor blade.

Figure 1:
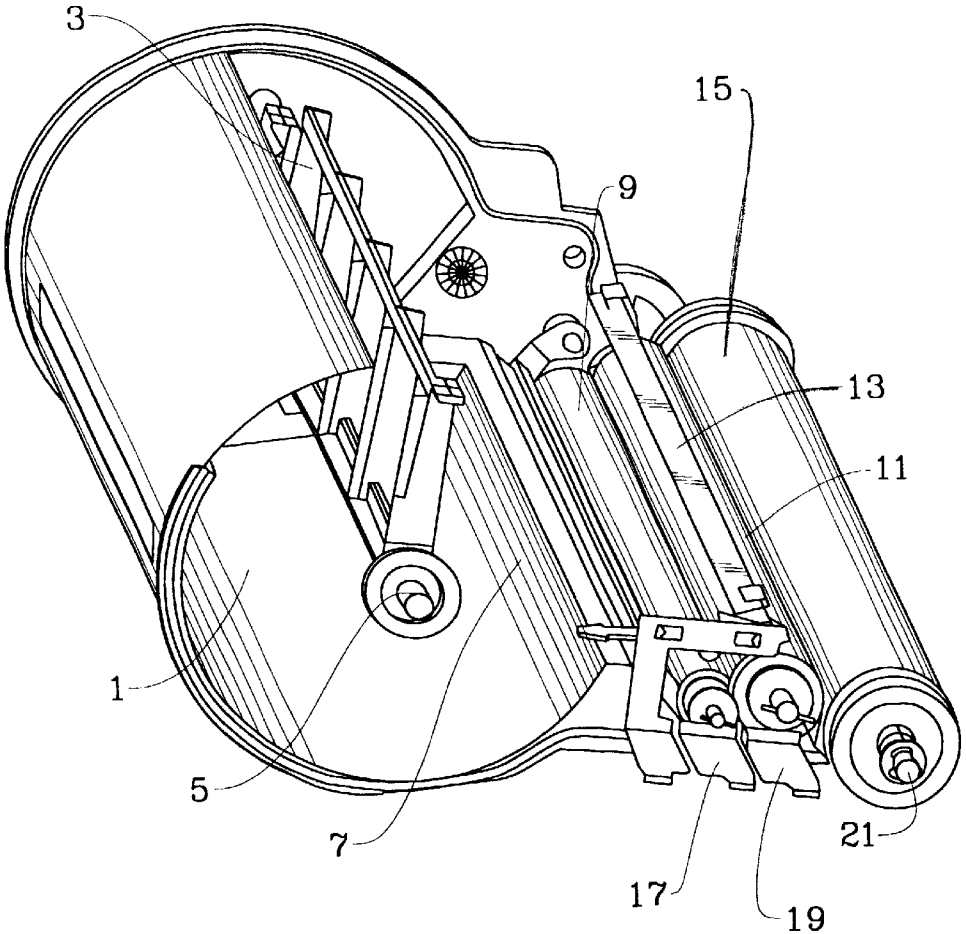
FIG. 1 PRIOR ART
FIG. 1 is a perspective, sectioned view illustrating a typical toner cartridge having a toner hopper and stirring paddle.

Referring to FIG. 1 a typical toner cartridge in accordance with this invention is shown having a toner-containing hopper 1 and a stirring paddle 3 fixedly mounted for rotation on a shaft 5. Toner (not shown) moves over wall 7 and comes in contact with a toner adder roller 9, which applies toner to a developer roller 11, both of which are rotated during operation. Toner on developer roller 11 passes under doctor blade 13 which presses against developer roller 11 before reaching photoconductor drum 15. Drum 15 carries an electrostatic image, as is standard, and that image attracts toner from developer roller 11 in the pattern of the image. All of the foregoing with respect to FIG. 1 is entirely standard and prior to this invention.

Contact pads 17 and 19 apply electrical bias voltages on roller 9 and 11 respectively. An electrical bias voltage is also applied to photoconductor drum 15 through its shaft 21.

Figure 2:
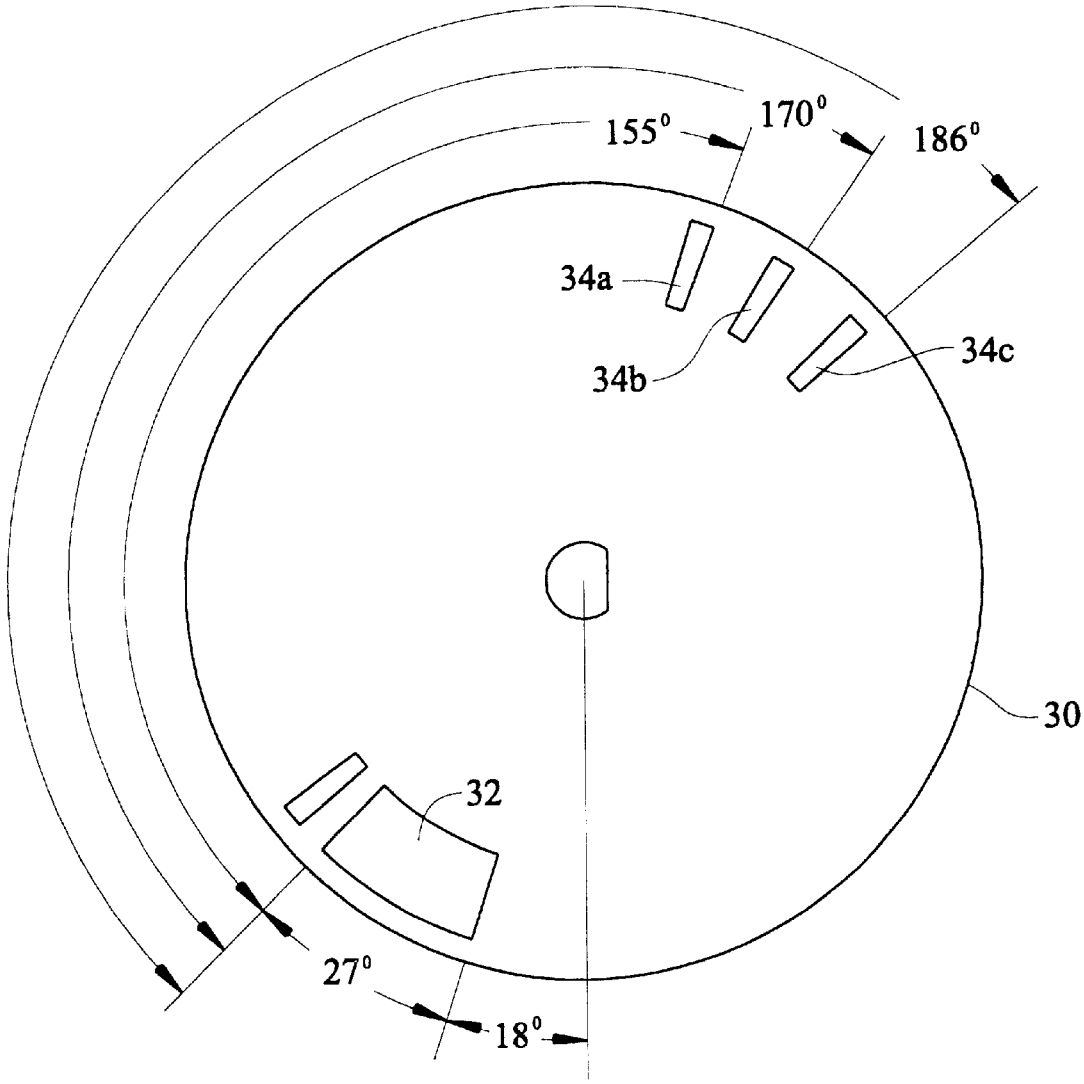
FIG. 2 is a front or elevation view of a representative encoder for use in the torsion measuring system, for which this invention is an improvement.

FIG. 2, illustrates a representative encoder wheel 30 from the front, along with toner paddle 3. Encoder wheel 30 is in rigid connection with paddle 3 and therefore the amount of rotation of wheel 30 directly describes the amount of rotation of paddle 3. Encoder wheel 30 is in yieldable connection with a drive source as will be further described below.

Encoder wheel 30 has a relatively wide window 32 defining a start location located to be sensed when paddle 3 is known to be above the level of toner. Encoder wheel 30 has three toner sensing windows. 34*a*, 34*b*, and 34*c*, located with their trailing edge 155 degrees, 170 degrees and 185 degrees respectively from the trailing edge of window 32, and located to be sensed when paddle 3 is at the deepest level of toner.

When the three sensing windows 34*a*, 34*b*, and 34*c* are employed, yield shown by each is determined separately from the others, and the one showing the greatest yield is selected as the best result. This compensates the uneven postures toner can take during use. Alternatively, a single toner-sensing window may be used, particularly when the toner hopper 1 is of moderate size. The encoder wheel 50 of FIG. 3 is such an alternative to encoder wheel 30.

Figure 3:
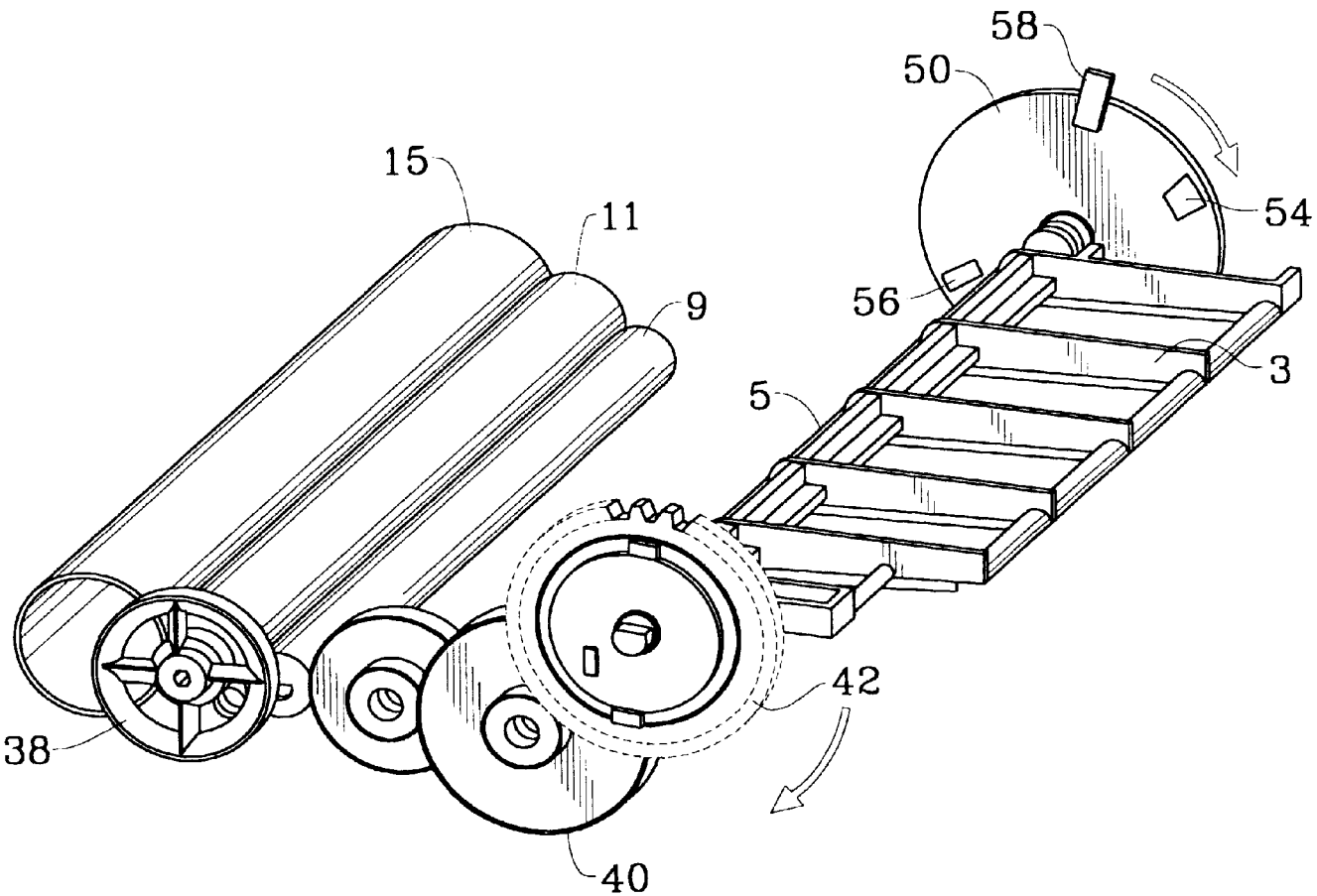
FIG. 3 PRIOR ART
FIG. 3 is a view of the encoder wheel and other selected elements of a cartridge such as that of FIG. 1.

FIG. 3 is closely based on a view of U.S. Pat. No. 5,634,169, assigned to the same assignee to which this application is assigned, and in part directed to measuring toner amount using the torsion spring drive to an encoder wheel 50. Encoder wheel 50 is modified from that of the patent to show only a beginning slot 54 and an ending slot 56 sensed by an optical sensor 58. Like parts to those in the previous figures are given the same reference numeral.

Figure 4:
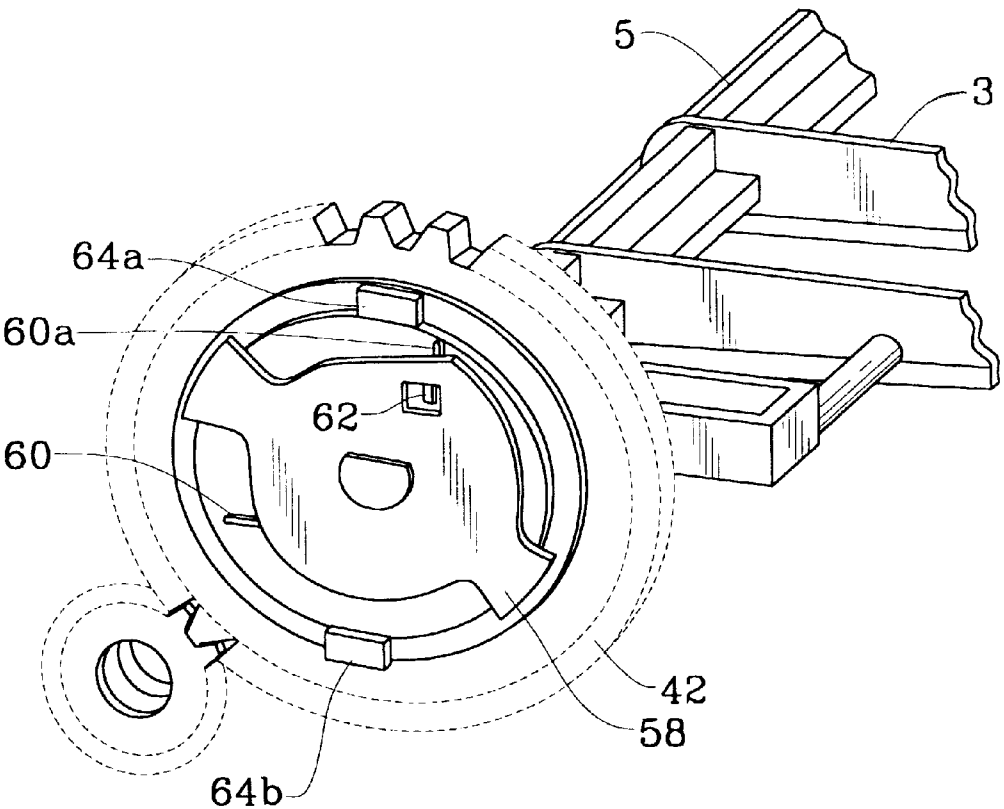
FIG. 4 PRIOR ART
FIG. 4 illustrates the torsion spring connected to drive the encoder wheel of FIG. 3.

As shown in FIG. 4, shaft 5 of paddle 3 is keyed to arbor 58. Drive gear 42 is connected to shaft 5 only through arbor 58. Arbor 58 carries a torsion spring 60 that is held by arbor 58 but that has a free end 60*a*. As gear 42 rotates free end 60*a* contacts a ledge 62 on arbor 58. This provides a force toward rotating shaft 5. However, spring 60 will yield depending on the amount of resistance caused by toner resisting movement of paddle 3. The amount of delay is directly shown by the movement of encoder 50 and so defines the amount of toner in the cartridge. However, when the cartridge has a large amount of toner, spring 60 may yield so much that ledges 64*a* and 64*b* on gear 42 contact arbor 58 and rotate the shaft 5 directly. The foregoing with respect to the encoder wheel is standard in some printers and prior to this invention.

Figure 5:
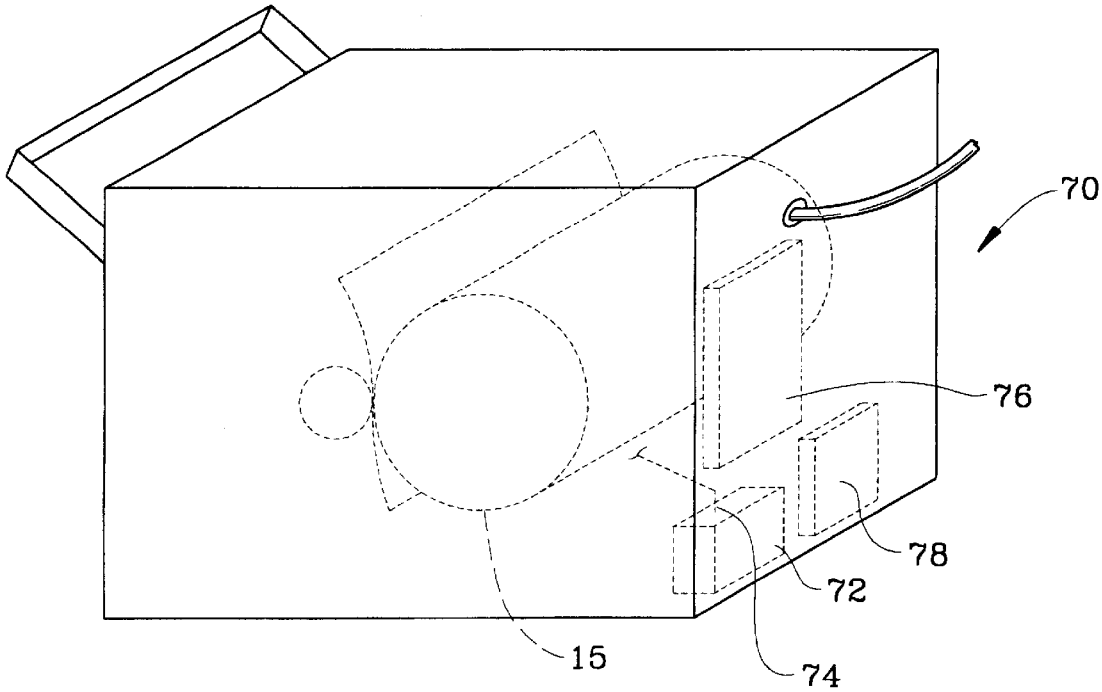
FIG. 5 is a block diagram representative of a printer or other imaging device and selected control elements in the device, FIG. 6A
Figure 6A:
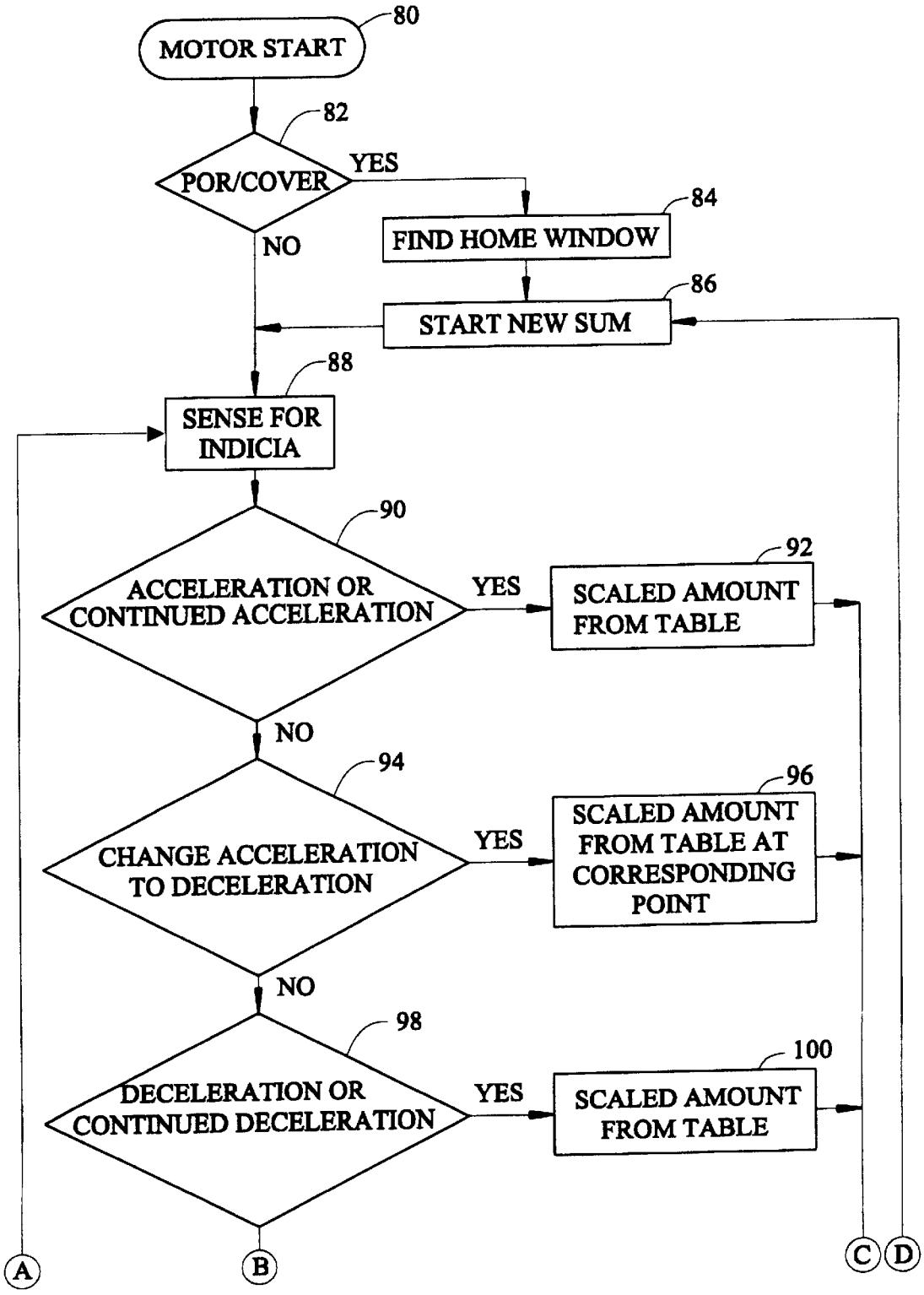
FIG. 6B is a flow diagram of the measuring operation in accordance with this invention.
Figure 6B:
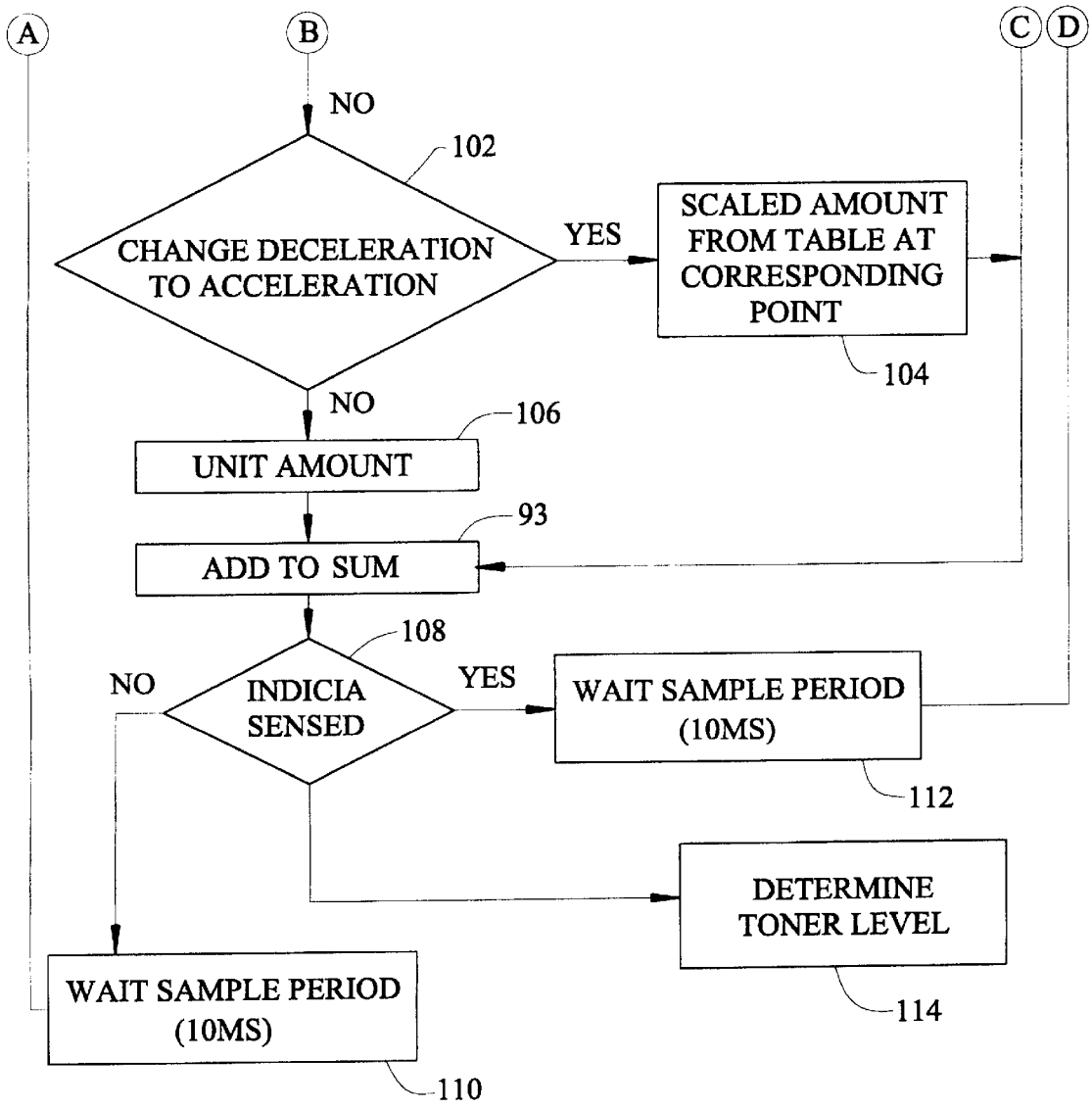

FIG. 5 illustrates a printer 70 with data processing apparatus resident in the imaging device employing a cartridge as described in the foregoing. The imaging device has a data processing apparatus, specifically microprocessor 72 for data processing operations. Alternatively, microprocessor 72 may be special purpose logic such as an ASIC (application specific integrated circuit). Microprocessor 72 issues control signals to the printer and cartridge on output conductors 74 (shown illustratively as a single lead). Microprocessor 72 connects to both RAM memory 76 and to NVRAM memory 78 and these memories store sums employed in this invention, either temporarily in RAM 76 or in NVRAM 78 at turn off of printer 70 so as to preserve the current location of encoder wheel 50. As is entirely standard, microprocessor 72 is programmed by a series of instructions to carry out required sequences of control signals on output conductors 74. In accordance with this invention those sequences include the following as shown in FIG. 6A and FIG. 6B.

During all printing, paddle 3 is rotated. Paddle rotation may be accelerated or decelerated, and over relatively long periods of time paddle rotation is either at steady state (which may be steady rotation or stopped). A change in paddle rotation is inherent in corresponding program instructions. Initial determination of rotation is a recognition of motor start 80.

At motor start 80 decision 82 determines if a power on reset (POR) or cover closed. Power on reset is a standard function in which printer 70 initiates control systems from what otherwise would be an unknown status after power has been off. Cover down also results in some level of unknown status as functioning is normally stopped when an operator opens the cover of a printer. Accordingly, when decision 82 is yes action 84 is initiated to find the home window 54 of encoder 50, and then to start a new count from zero in action 86. Sensing for windows 56 and 54 is begun in action 88.

Deceleration is by turning off the motor, so often the motor comes on without a POR or the cover having been opened.

When decision 82 is no, an accurate count is in progress and action 88 is begun immediately. At action 88, the system recognizes from the software being implemented whether the motor is to be driven (consistent with acceleration and rotation at steady state) or not driven (consistent with deceleration or stopped). This results in four different responses implemented by two different tables of values.

If the action occurring is acceleration from stopped or continued acceleration, decision 90 is yes and the first or next sequential entry from the acceleration table is obtained in action 92 (the first entry being that for immediately after stopped and each following entry being for the next sequential continuous acceleration). This amount is added to the previous sum of the scaled amount adder in action 93.

If the action occurring is change to deceleration from acceleration, decision 94 is yes. The deceleration table is entered at a corresponding position for the current speed and the entry obtained in action 96. This amount is added to the previous sum of the scaled amount adder in action 93.

The corresponding position between acceleration and the deceleration table and between deceleration and the acceleration table is that location corresponding to the current speed at the time of entry. Accordingly, it is the inverse in the sequence of the tables. As an illustrative example, if the acceleration table has 200 different entries and the deceleration table has 100 different entries, a change to deceleration next after entry 150 would result in the deceleration table (discussed immediately below) to be entered at entry 25.

If the action occurring is deceleration from steady state rotation or continued deceleration, decision 98 is yes and the first or next sequential entry from the deceleration table is obtained in action 100 (the first entry being that for immediately after steady state rotation and each following entry being for the next sequential continuous deceleration). This amount is added to the previous sum of the scaled amount adder in action 93.

If the action occurring is change to acceleration from deceleration, decision 102 (FIG. 6B) is yes. The acceleration table is entered at a corresponding position for the current speed and the entry obtained in action 104. This amount is added to the previous sum of the scaled amount adder in action 93.

During continued deceleration, each scaled factor for successive regular intervals of time is necessarily smaller as the paddle is undergoing deceleration. Similarly, during continued acceleration, each scaled factor for successive regular intervals of time is necessarily larger as the paddle is undergoing acceleration. Reaching the highest entry for acceleration is responded to as a steady state condition, and decision 90 becomes no.

Accordingly, when steady state rotation is reached, decisions 90, 94, 98, and 102 are no, which results in action 106, obtaining the steady state rotation value. The value for rotation at steady state is a unitary (unscaled) amount for each time period. This amount is added to the previous sum of the scaled amount added in action 93.

In addition to the summing just described, the encoder wheel sensor 58 is observed at each interval for presence of indicia 54 or 56 in decision 108. When no, a sample period wait of ten millisecond is carried out in action 110 and action 88 is resumed once again and the existing value of the scaled amount adder is increased or decreased as described in accordance with the current status.

When decision 108 is yes, a sample period wait of ten milliseconds is carried out in action 112 and action 86 is resumed once again. The value of the scaled amount adder is then started at zero.

The periodic action of decision 108 is a basis for action 114, the determination of toner level based on the sum of the scaled amount added and the observation of indicia.

A known operation for printers and the like in standby mode is to jog the developer mechanism after long intervals. This is to prevent a compression set of any soft roller in the printer, a fuser back-up roller being an example. This is a short acceleration from stopped followed by a short deceleration to stopped, and is readily tracked by the foregoing.

Figure 7:
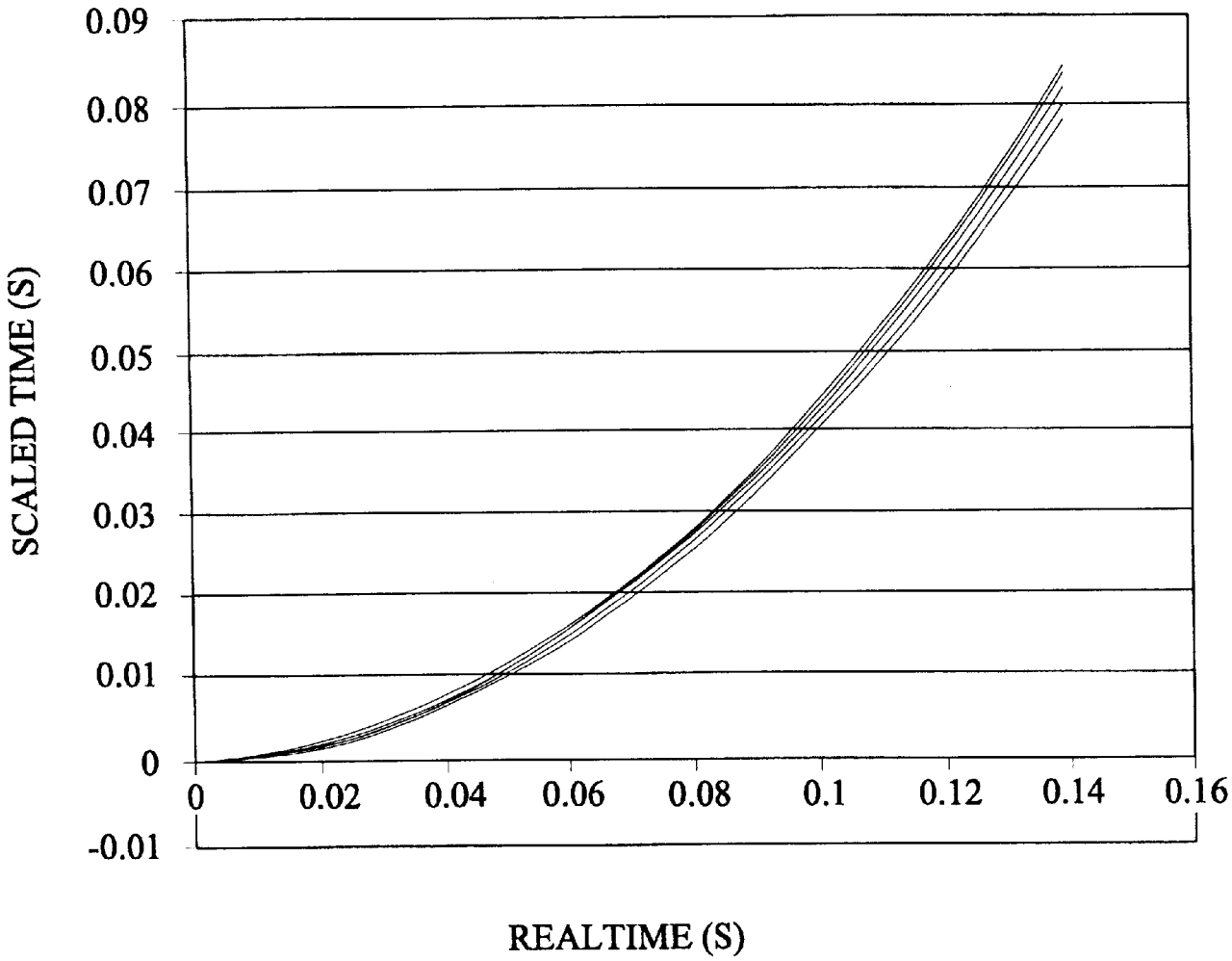
FIG. 7 is a plot for acceleration of real time versus scaled time of the "best fit" for data taken at various operating voltages of a drive motor within the range of expected tolerances of the drive voltage.
Figure 8:
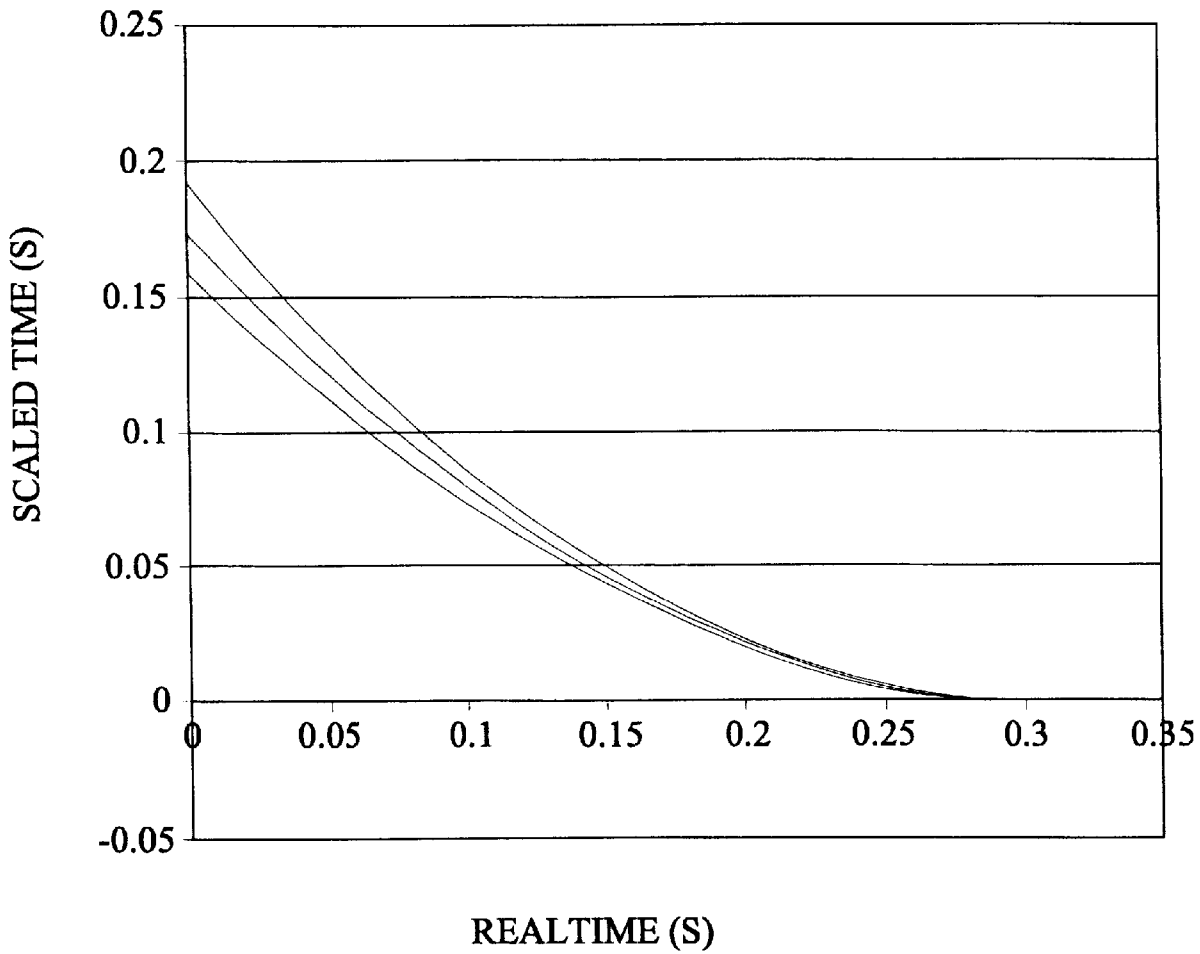
FIG. 8 is a plot for deceleration of real time versus scaled time of the "best fit" for data taken at various operating voltages of a drive motor within the range of expected tolerances of the drive voltage.

Although the use of tables holding empirically determined data conceptually is not mathematical, empirical data of movements typically can be modeled mathematically. For the implementation disclosed, a number of measurements were made at various voltage levels to the motor driving the cartridge as described. The differences were consistent with those found in actual practice. They were then plotted and a best-fit equation obtained using standard software. The plots are shown in FIG. 7 for acceleration and FIG. 8 for deceleration, in which real time is the horizontal axis and equivalent (scaled) time is the vertical axis.

The acceleration formula resulting was a function of real time squared times a factor of 4.15 with two other amounts so small as to be insignificant. Of course, a formula varying by the square of time is that of ideal, unimpaired acceleration.

The deceleration formula resulting was a function of real time squared times a factor of 1.93, less 1.15 times real time, plus 0.17. This could be readily used directly for computation for this invention in place of the look-up table 98.

Alternative implementations will be apparent as the computation may be made by a wide variety of data processing techniques and the yieldable drive may take various forms.

What is claimed is:

1. An imaging device comprising a toner hopper, a paddle mounted for rotation in said toner hopper, a tracking member mounted integral with said paddle for rotation with said paddle, said tracking member having at least two, spaced indicia capable of being sensed, a sensing apparatus mounted at a predetermined location in said imaging device for sensing said indicia, a yieldable drive connection from a source of drive rotation to said paddle to rotate said paddle, data processing apparatus to compute scaled amounts representative of amount of rotation of said paddle during acceleration of said paddle rotation based on the speed of said paddle rotation at the start of acceleration until said acceleration changes to deceleration or to steady state, data processing apparatus to compute scaled amounts representative of amount of rotation of said paddle during deceleration of said paddle rotation based on the speed of said paddle rotation at the start of deceleration until said deceleration changes to acceleration or to steady state, data processing apparatus to define unitary amounts representative of amount of rotation of said paddle during steady state rotation, data processing apparatus to determine a sum of said scaled amounts from acceleration, said scaled amounts from deceleration, and said unitary amounts, and data processing apparatus responsive to the sensing of said indicia by said sensing apparatus and to said sum of said scaled amounts from acceleration, said scaled amounts from deceleration, and said unitary amounts to determine the yield of said drive connection.

2. The imaging device as in claim 1 in which said scaled amounts are amounts determined from empirical data.

3. The imaging device as in claim 1 in which said scaled amounts arc determined by obtaining data from a look-up table in data processing memory at regular intervals.

4. The imaging device as in claim 2 in which said scaled amounts are determined by obtaining data from a look-up table in data processing memory at regular intervals.

5. The imaging device as in claim 1 in which said tracking member is an encoder wheel.

6. The imaging device as in claim 2 in which said tracking member is an encoder wheel.

7. The imaging device as in claim 3 in which said tracking member is an encoder wheel.

8. The imaging device as in claim 4 in which said tracking member is an encoder wheel.

9. The imaging device as in claim 1 also comprising data processing apparatus which issues control signals to control start of acceleration of said imaging device and to control start of deceleration of said imaging device, and said data processing apparatus to compute scaled amounts employ said control signals to recognize start of acceleration and start of deceleration.

10. The imaging device as in claim 2 also comprising data processing apparatus which issues control signals to control start of acceleration of said imaging device and to control start of deceleration of said imaging device, and said data processing apparatus to compute scaled amounts employ said control signals to recognize start of acceleration and start of deceleration.

11. The imaging device as in claim 3 also comprising data processing apparatus which issues control signals to control start of acceleration of said imaging device and to control start of deceleration of said imaging device, and said data processing apparatus to compute scaled amounts employ said control signals to recognize start of acceleration and start of deceleration.

12. The imaging device as in claim 4 also comprising data processing apparatus which issues control signals to control start of acceleration of said imaging device and to control start of deceleration of said imaging device, and said data processing apparatus to compute scaled amounts employ said control signals to recognize start of acceleration and start of deceleration.

13. The imaging device as in claim 5 also comprising data processing apparatus which issues control signals to control start of acceleration of said imaging device and to control start of deceleration of said imaging device, and said data processing apparatus to compute scaled amounts employ said control signals to recognize start of acceleration and start of deceleration.

14. The imaging device as in claim 6 also comprising data processing apparatus which issues control signals to control start of acceleration of said imaging device and to control start of deceleration of said imaging device, and said data processing apparatus to compute scaled amounts employ said control signals to recognize start of acceleration and start of deceleration.

15. The imaging device as in claim 7 also comprising data processing apparatus which issues control signals to control start of acceleration of said imaging device and to control start of deceleration of said imaging device, and said data processing apparatus to compute scaled amounts employ said control signals to recognize start of acceleration and start of deceleration.

16. The imaging device as in claim 8 also comprising data processing apparatus which issues control signals to control start of acceleration of said imaging device and to control start of deceleration of said imaging device, and said data processing apparatus to compute scaled amounts employ said control signals to recognize start of acceleration and start of deceleration.

* * * * *